US008044610B2

(12) United States Patent
Sandner et al.

(10) Patent No.: US 8,044,610 B2
(45) Date of Patent: Oct. 25, 2011

(54) LED DRIVER WITH ADAPTIVE ALGORITHM FOR STORAGE CAPACITOR PRE-CHARGE

(75) Inventors: Harald Sandner, Marzling (DE); Christophe Vaucourt, Munich (DE); Hans Schmeller, Woerth (DE); Martin Rommel, Freising (DE); Helmut Kiml, Tiefenbach (DE)

(73) Assignee: Texas Instruments Incorporated, Dallas, TX (US)

( * ) Notice: Subject to any disclaimer, the term of this patent is extended or adjusted under 35 U.S.C. 154(b) by 442 days.

(21) Appl. No.: 12/260,156

(22) Filed: Oct. 29, 2008

(65) Prior Publication Data

US 2009/0108775 A1 Apr. 30, 2009

(30) Foreign Application Priority Data

Oct. 30, 2007 (DE) ..... 10 2007 051 793

(51) Int. Cl.
*H05B 37/02* (2006.01)
*H05B 39/04* (2006.01)
*H05B 41/36* (2006.01)

(52) U.S. Cl. ..... 315/297; 315/307; 315/324

(58) Field of Classification Search ..... 315/185 R, 315/209 R, 246, 247, 224–226, 291, 297, 315/294, 295, 298–302, 306–312, 314, 324; 361/83, 88–90, 91.1, 91.2, 91.3, 91.5, 92, 361/93.1, 103, 106; 345/102, 204, 207, 211–214
See application file for complete search history.

(56) References Cited

U.S. PATENT DOCUMENTS

2004/0164685 A1 8/2004 Dygert
2004/0208011 A1 10/2004 Horiuchi et al.
2005/0104542 A1 5/2005 Ito et al.
2005/0225515 A1 10/2005 Tsuchida et al.
2005/0248322 A1 11/2005 Kagemoto et al.
(Continued)

FOREIGN PATENT DOCUMENTS

DE 1093192 11/1960
(Continued)

OTHER PUBLICATIONS

Deutsche Patent und Markemant, Office Action issued regarding German Patent Application DE 10 2007 051 793.0 dated Oct. 30, 2007.

*Primary Examiner* — Shawki S Ismail
*Assistant Examiner* — Jany Tran
(74) *Attorney, Agent, or Firm* — John J. Patti; Wade J. Brady, III; Frederick J. Telecky, Jr.

(57) ABSTRACT

A method is provided for driving a plurality of light emitters in a plurality of output paths with each output path including at least one light emitter. The method includes the steps of applying a supply voltage level to a plurality of output paths; generating a current for each path during a period of a predetermined length for the output path; sensing a current level for each output path during the period; comparing each sensed current level with a reference level; increasing the supply voltage level if the sensed current level is lower than the reference level; determining a lowest supply voltage level for the worst case output path; and using the lower supply voltage level as a common supply voltage level for all output paths.

17 Claims, 2 Drawing Sheets

U.S. PATENT DOCUMENTS

| | | | | |
|---|---|---|---|---|
| 2006/0108933 | A1 | 5/2006 | Chen | |
| 2007/0091036 | A1 | 4/2007 | Han et al. | |
| 2007/0139317 | A1 | 6/2007 | Martel et al. | |
| 2007/0195025 | A1 * | 8/2007 | Korcharz et al. | 345/82 |

FOREIGN PATENT DOCUMENTS

| | | | |
|---|---|---|---|
| DE | 10318780 | A1 | 12/2004 |
| DE | 102004034359 | B3 | 2/2006 |
| DE | 1005012663 | A1 | 9/2006 |
| DE | 102005028403 | A1 | 12/2006 |
| DE | 102005030123 | A1 | 1/2007 |
| EP | 1499165 | | 1/2005 |
| EP | 1499165 | A2 | 1/2005 |
| EP | 1503430 | A1 | 2/2005 |
| EP | 1511088 | A1 | 3/2005 |
| WO | WO2007096868 | | 8/2007 |

* cited by examiner

LED DRIVER WITH ADAPTIVE ALGORITHM FOR STORAGE CAPACITOR PRE-CHARGE

CROSS-REFERENCE TO RELATED APPLICATIONS

This claims priority to German Patent Appl. Ser. No. 102007051793.0 filed on Oct. 30, 2007, which is hereby incorporated by reference for all purposes.

TECHNICAL FIELD

The invention relates generally to an electronic device and, more particularly, to a driver for a plurality of light emitting semiconductors.

BACKGROUND

Mobile portable devices, such as cameras and/or mobile phones, use light emitting diodes (LEDs). In particular, LED-based flash lights or flash strobes use a relatively high current, which is provided to the LEDs. This high current is typically drawn from a low voltage storage capacitor or super-capacitor. This capacitor is charged during normal operation and used to provide the peak current during flash light periods. The low voltage super-capacitor generally introduces reduced peak current loading from the battery. In order to reduce the power losses, thermal stresses and solution size (in terms of circuit complexity) in the camera flash driver integrated circuit (IC), a desired pre-charged voltage for the super-capacitor must be determined and used. The desired pre-charge voltage for the super-capacitor is a function of the LEDs' electrical characteristics, such as forward voltage vs. forward current characteristic, which can have a wide spread over a large volume production. There are also other parameters that are considered, such as the upper threshold flash current level, the equivalent series resistance (ESR) in the discharge path, and the thermal performance of the camera flash driver IC from a system level perspective.

Some examples of conventional devices are U.S. Patent Pre-Grant Pub. Nos. 2004/0164685, 2006/0108933, 2005/0104542, 2007/0139317, and 2005/0248322; German Patent or Patent Appl. Nos. 102005012663, 10318780, 102005028403, 10393129, 102004034359, and 102005030123; and European Patent or Patent Appl. Nos. 1503430, 1511088, 1499165.

SUMMARY

An embodiment of the present invention, accordingly, provides a method for driving a plurality of light emitting semiconductors. The plurality of light emitting semiconductors is arranged in a plurality of output paths each output path comprising at least one light emitting semiconductor and a current regulator for determining a current through the output path. The method can be comprised of the following steps in any combination:

applying an initial supply voltage level to an output path, controlling the current regulator so as to generate a high current during a high current period of a predetermined length through the output path, sensing a current level through the output path during the high current period, comparing the sensed current level with a lower threshold reference level, increasing the supply voltage level if the sensed current level is lower than the lower threshold reference level, and performing the forgoing steps with the increased supply voltage level, otherwise performing the foregoing steps for another output path, and detecting throughout this procedure a lowest supply voltage level for the worst case output path, and using the lowest supply voltage level as a common supply voltage level for all output paths.

In accordance with another embodiment of the present invention, a plurality of output paths is provided, with each output path having a light emitting semiconductor. An output path can include a single or plural light emitting semiconductor, which can be coupled in series or in parallel. An initial supply voltage level (which is preferably rather low) is used for supplying at least one of the output paths. The current regulator is then switched on in order to source a relatively high current, as desired, to generate a flash light with the one or multiple light emitting semiconductors. This is a high current period, during which a considerably high current is drawn from the power supply. However, dependent on the lower threshold voltage drop across the light emitting semiconductor and the current regulator, it is possible that the current cannot flow through the light emitting semiconductor. Such a situation is detected and the supply voltage is increased by a predetermined amount (for example, stepwise by a predetermined step). Again, the current regulator is switched on in order to source the current. If this time the supply voltage was high enough, the supply voltage level is stored and another output path is checked. After having checked all output paths, the upper threshold supply voltage level among all the checked output paths will be the lower threshold supply voltage level that can be used if all output paths are to be supplied with a single common supply voltage. The method according to an embodiment of the present invention provides an adaptive initialization routine that allows the lower threshold supply voltage level to be found for a plurality of output paths. Without the adaptive calibration routine a supply voltage level is to be used having a safety margin which includes the entire relevant production spread, all parasitic effects (for example, resistance of interconnections), and so forth.

According to an aspect of the present invention, the current level in each output path can be sensed by use of a voltage drop across the current regulator of a path. The lower threshold current used in the respective output path is then represented by a lower threshold reference voltage level, which is selected with respect to specific implementation. This configuration can be used in order to determine the current level.

The light emitting semiconductor(s) can be a light emitting diode(s) and the high current through the output path can relate to a flash strobe performed with the light emitting diode(s). This is one typical application for the embodiment of the present invention. However, other applications may also profit from the adaptive search algorithm according to various embodiments the present invention.

According to an advantageous aspect of the present invention, the current regulators in the output paths can be controlled to perform the high current period at the same time. This allows conditions to be established that correspond to the final application. The current drawn from the power supply (for example, a battery or an accumulator) is then in an order equal to the current during the real flash light. Therefore, it could be seen whether or not the supply voltage level used to drive the output paths is sufficient under realistic conditions. The situation during the high current phase may even be more realistic if the current through the output paths during the high current period is supplied by a super-capacitor. Preferably, the super-capacitor can provide the current during a high current phase during normal operation. This aspect of the invention allows the equivalent series resistance of the super-capacitor to be included in the calibration procedure. Moreover, the inter-connecting structures, such as wires, PCB paths, and so forth, can be included in the procedure. However, the specific electrical characteristics of the interconnections and the battery can also be stored and used only when the final desired pre-charge voltage level is determined based on the lower threshold supply voltage level used for the worst case path. The desired pre-charge voltage of a super-capacitor in a driving circuit for light emitting semiconductors can be determined from the desired supply voltage level so that an on-chip adaptive search algorithm is provided for finding the desired super-capacitor pre-charge voltage for automatic calibration of the desired pre-charge voltage. An additional safety margin can be added to the supply voltage level in order to take account of the equivalent series resistance of the capacitor and other parasitic effects. The desired pre-charge voltage which is derived from lower threshold supply voltage level for the worst case output path includes a voltage drop which is due to the equivalent series resistance of the super-capacitor present during the high current period.

The method can also comprise generating a digital code representing the desired supply voltage level. The corresponding supply voltage digital code is returned when it is determined which is the worst case output path and the supply voltage has been controlled such that the desired supply voltage level is provided in the worst case output path. Calibration of the desired supply voltage level (and therefore the desired pre-charge voltage of the super-capacitor or storage capacitor) can then be easily implemented as a test procedure during a manufacturing process.

The present invention also relates to an electronic device comprising a driver for driving a plurality of light emitting semiconductors in a plurality of output paths. Each output path can comprise at least one light emitting semiconductor, and a current regulator for determining a current through an output path. The electronic device comprises a control stage adapted to apply an initial supply voltage level to an output path and to control the current regulator in the output path so as to generate a high current during a predetermined period of time through the output path. The control stage is further adapted to sense a current level through the output path and to compare the sensed current level with a lower threshold reference level. Then, the control stage increases the supply voltage level if the sensed current level is lower than the lower threshold reference level and performs another comparison. If the sensed current level is greater than the reference level, the control stage stops the procedure for the output path and stores the determined supply voltage level value. The control stage is further adapted to perform the comparison and determination of the lower threshold supply voltage level for all output paths, so as to determine the lower threshold supply voltage level for all output paths. The selected lower threshold supply voltage level that can be used for all output paths will then be the upper threshold supply voltage level for the worst case output path, for example, the output path having the upper threshold voltage drop across the light emitting semiconductor. The control stage can be adapted to perform the supply voltage checking for each output path separately, sequentially, or in parallel, or in a variety of other combinations. The electronic device according to the present invention can comprise the current regulators and it can be adapted to measure the voltage drop across the current regulators in order to determine whether or not the current can flow and whether or not the supply voltage level applied to the output path is high enough.

By worst case output path, it is meant the output path that has the worst case sensed voltage level (for example, the light emitting semiconductor that has the largest forward voltage). A flash strobe is generated in the worst case output path by the control stage. The control stage also controls the supply voltage so that the worst case output path has a desired supply voltage level. This desired supply voltage level is then used by the control stage for all of the output paths. In this way, the device of the present invention integrates a self-calibration procedure that can be used to determine the desired supply voltage based on the actual worse case light emitting semiconductor forward voltage, which provides automatic calibration of the desired supply voltage.

In one aspect of the invention, the light emitting semiconductor is an LED. The current regulator comprises a MOSFET coupled in series with the LED and used as low-side current regulator, and the voltage level is sensed between a cathode of the LED and ground. Each LED has its cathode coupled to a MOSFET transistor in series via the sensor(s). The calibration procedure monitors the sensed voltage across each of the MOSFETs used as low-side current regulators and registers the worst case LED forward voltage. From the worst case LED forward voltage, the desired supply voltage can then be determined.

However, according to another aspect of the present invention, also a high side current regulator instead of low side current regulator can be used. In this aspect of the invention, the light emitting semiconductor can be an LED, and the current regulator comprises a MOSFET coupled in series with the LED and used as high-side current regulator, and the voltage level is sensed between the output node coupled to the respective output path (or all output paths) and an anode of the LED. Each LED has its anode coupled to a MOSFET transistor in series via the sensor(s). The calibration procedure monitors the sensed voltage across each of the MOSFETs used as high-side current regulators and registers the worst case LED forward voltage. From the worst case LED forward voltage, the desired supply voltage can then be determined.

Preferably, a super-capacitor is coupled to the plurality of output paths. The control stage can then be further adapted to charge the super-capacitor to the desired supply voltage level. The super-capacitor is used as a storage capacitor and is connected to each of the output paths. Based on the worst-case output path voltage and the desired supply voltage, the control stage then determines the desired super-capacitor pre-charge voltage so that the super-capacitor can be charged to the desired supply voltage level.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
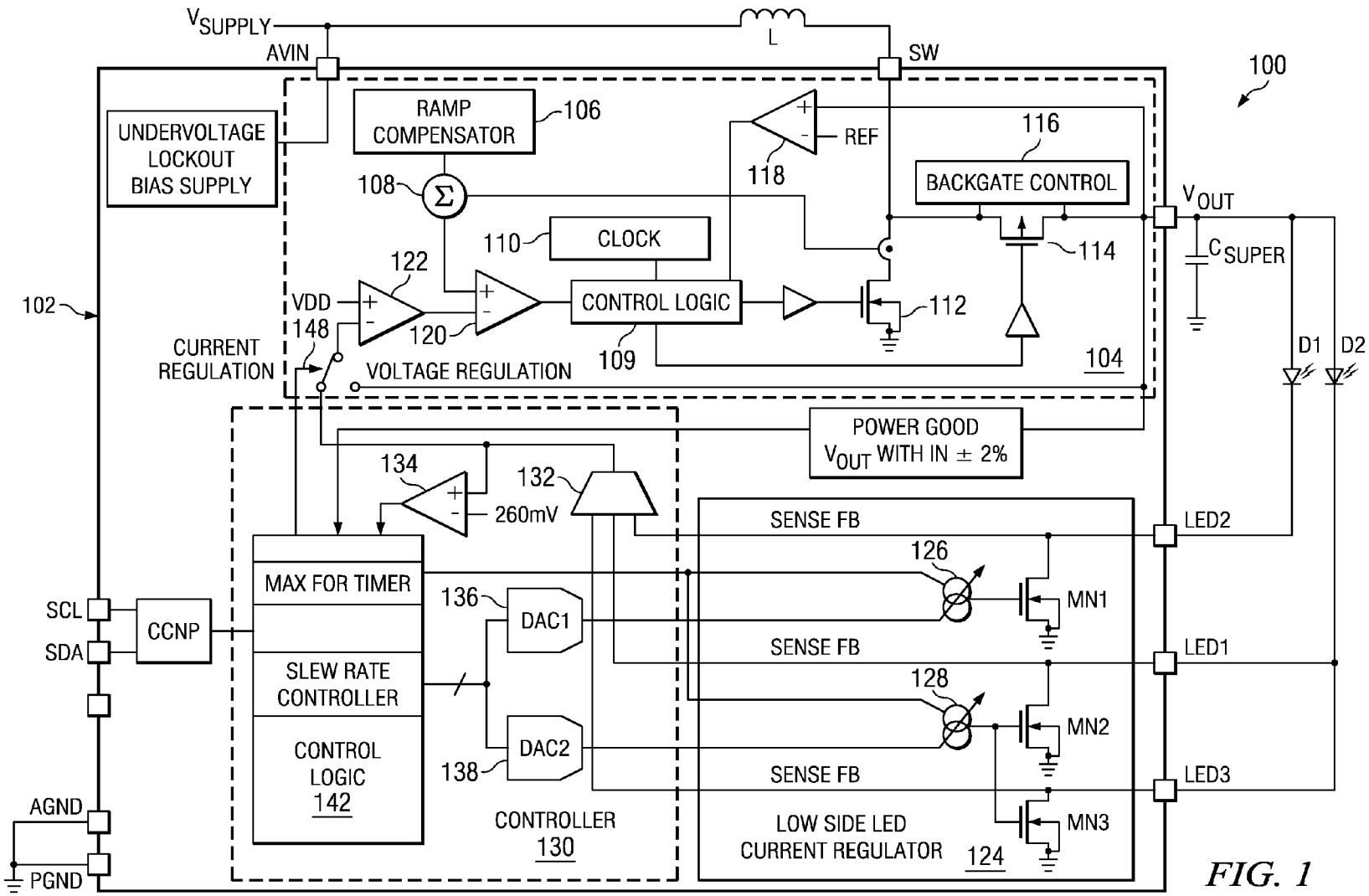
FIG. 1 is a simplified circuit diagram of an electronic device in accordance with the invention.

Refer now to the drawings wherein depicted elements are, for the sake of clarity, not necessarily shown to scale and wherein like or similar elements are designated by the same reference numeral through the several views.

Referring to FIG. 1, the reference numeral 100 generally designates a simplified circuit diagram of an electronic device according to the invention. Preferably, the circuit 100 is comprised of an IC 102 and various external elements (such as inductor L). IC 102 includes a number of terminals or pads AVIN, SW, $V_{out}$, LED1, LED2, LED3, PGND, SDA, and SCL that allow external components to interact with the circuitry within IC 102. Additionally, within circuit 100, a supply voltage rail $V_{supply}$ is provided, which can be provided by a battery and which is connected to a power converter. Preferably, the power converter is a boost converter. As shown, rail $V_{supply}$ is coupled in series with an inductor L. The inductor L is coupled to driver circuitry or driver 104 that drives the LEDs D1 and D2 or other light emitting semiconductors. The anodes of the diodes D1 and D2 are coupled to a super-capacitor $C_{super}$ and a supply voltage rail $V_{out}$ so that the diodes D1 and D2 are provided in two output paths. Together inductor L, driver 104, and super-capacitor $C_{super}$ comprise a power converter, which (as shown) is a boost converter.

In operation, the power converter steps-up or increases the voltage from $V_{supply}$. Preferably, control logic 109 and clock 110 (preferably a 2 Mhz Oscillator) provide control signals to switches 112 and 114 (which are preferably n-channel MOSFETs) in order to actuate each switch 112 and 114. To generate these control signals, the control logic 109 receives an output from comparator 118, which compares this output voltage to a reference voltage REF. Additionally, the output of ramp compensator 106 is added to the voltage at the node between the switches 112 and 114 by adder 108. The sum is then compared by comparator 120 to a signal from differential amplifier 122. Comparator 120 provides an additional feedback signal to the control logic 109. Moreover, a back-gate control 116 is provided in parallel to the switch 114.

The circuitry of the driver 104, thus, allows the inductor L to be coupled to the super-capacitor $C_{super}$. The super-capacitor $C_{super}$, which is used as a storage capacitor, is connected between the supply voltage rail $V_{out}$ and ground. The voltage at the supply voltage rail $V_{out}$ is used as the pre-charge voltage of the capacitor $C_{super}$. Therefore, voltage and current can be supplied to LEDs D1 and D2.

Cathodes of the LEDs D1 and D2 are coupled to IC 102 at LED1, LED2 and LED3 to have the voltages across LEDs D1 and D2 sensed. Each of LED1, LED2 and LED3 is coupled to a current regulator 124. Current regulator 124 is comprised of transistors MN1, MN2 and MN3 (which are preferably NMOS transistor) and controllable current sources 126 and 128. Each of the current sources 126 and 128 receives an on/off signal and a current control signal from controller 130. This allows the current source 126 and 128 to actuate transistors MN1, MN2 and MN3, which are each coupled between one of LED 1, LED2, and LED3 and ground.

Additionally, each of LED1, LED2 and LED3 is coupled to controller 130. The controller 130 has a multiplexer 132, control logic 142, digital to analog converters (DACs) 136 and 138, and a comparator 134. Multiplexer 132 receives outputs from LED 1, LED2 and LED3, and comparator 134 receives the sensed voltage of the LEDs D1 and D2 via the multiplexer 132 at its positive input and a reference voltage at its negative input. Preferably, multiplexer 132 receives and outputs the worst case value, which is then fed to the comparator 134. However, the sensing and comparing procedure can also be performed sequentially instead of in parallel. The output of the comparator 134 is connected to the control logic 142. The control logic 142 has an output for regulating the supply voltage $V_{out}$, and is connected thereto by a switch 148 and further control logic. The switch 148 is operable to switch between negative input of amplifier 122 (for current mode regulation) and the supply voltage rail $V_{out}$ (for voltage regulation mode). The switch 148 and the two different modes are useful to implement the procedure according to the present invention.

While an initial supply voltage level is applied to an output path, the DC-DC or power converter operates in voltage regulation mode (where switch 148 is coupled to $V_{out}$). When the current regulator 124 is controlled so as to generate a high current during a high current period of a predetermined length through each output path, a current level is sensed through each output path during the high current period, and the sensed current level is compared with a lower threshold reference level.

Another output of the control logic 142 is coupled to the DACs 136 and 138, which have outputs coupled to the current sources 126 and 128, so that the controller 130 can be used to control the current regulator 124 and to control the current through the LEDs D1 and D2. If high-side current regulators are used instead of the low-side current regulator 124, there would be a number of PMOS transistors instead of the NMOS transistors MN1 to MN3. These PMOS transistors would be coupled between the output node and the anodes of the LEDs D1 and D2. With high-side drivers, the voltage drop between the supply voltage rail $V_{out}$ and the anodes of the diodes is sensed and used to detect the worst case path.

In operation, the voltage level of the output paths comprising the LEDs D1 and D2 is sensed. The sensed voltage is fed to the positive input of the comparator 134 via the multiplexer 132, and the comparator 134 compares the sensed voltage with the reference voltage. In the configuration shown, the multiplexer 132 receives all sensed voltage values in parallel and outputs the worst case value. However, sequential testing of sensed values is also possible. On the basis of the comparison, the comparator 134 determines which of the LEDs, D1 or D2, has the highest forward voltage.

The output path having the LED with the highest forward voltage is called the worst case output path. The determination of the worst case output path is performed by the control logic 142. The control logic 142 increases the voltage at the supply voltage rail $V_{out}$ as long as necessary until the voltage drop across the current regulator 124 corresponding to an output path increases above a lower threshold reference level during a high current period. The high current period can be a flash strobe of one or all LEDs. In the example shown, the lower threshold reference level at the comparator input can be 260 mV. The length of a flash ranges from several tenths of microseconds to several hundreds of milliseconds. This is the time during which the current must be supplied to the LEDs participating in the flash.

The same procedure is performed for all output paths, either in parallel or sequentially. The upper threshold supply voltage used is the supply voltage for the worst case output path. Based on the upper threshold supply voltage level of the worst case path, a desired pre-charge voltage for the super-capacitor $C_{super}$ is determined. Either the desired pre-charge voltage is chosen to be greater than the voltage sensed in the worst case output path to allow a margin for the voltage drop across the internal resistance in the super-capacitor $C_{super}$ or all parasitic effects can be included in the calibration process. This can be done if all participating output paths are switched on at once in the same manner as during normal flash operation. Preferably, the super-capacitor $C_{super}$ can be used during this process such that the pre-charge voltage already is the supply voltage level used for the flash strobe. However, the procedure according to the present invention may also be performed without the super-capacitor $C_{super}$ and a margin can be included considering the effects of the super-capacitor $C_{super}$.

After having finished the initial adaptive calibration process, and during normal operation, the controller 130 charges the super-capacitor $C_{super}$ to the desired pre-charge voltage level. Then the control logic 142 controls the current regulator 124 to allow enough current through the corresponding LED D1 or D2 to generate a short duration flash strobe even in the worst case output path comprising the LED D1 or D2.

Figure 2:
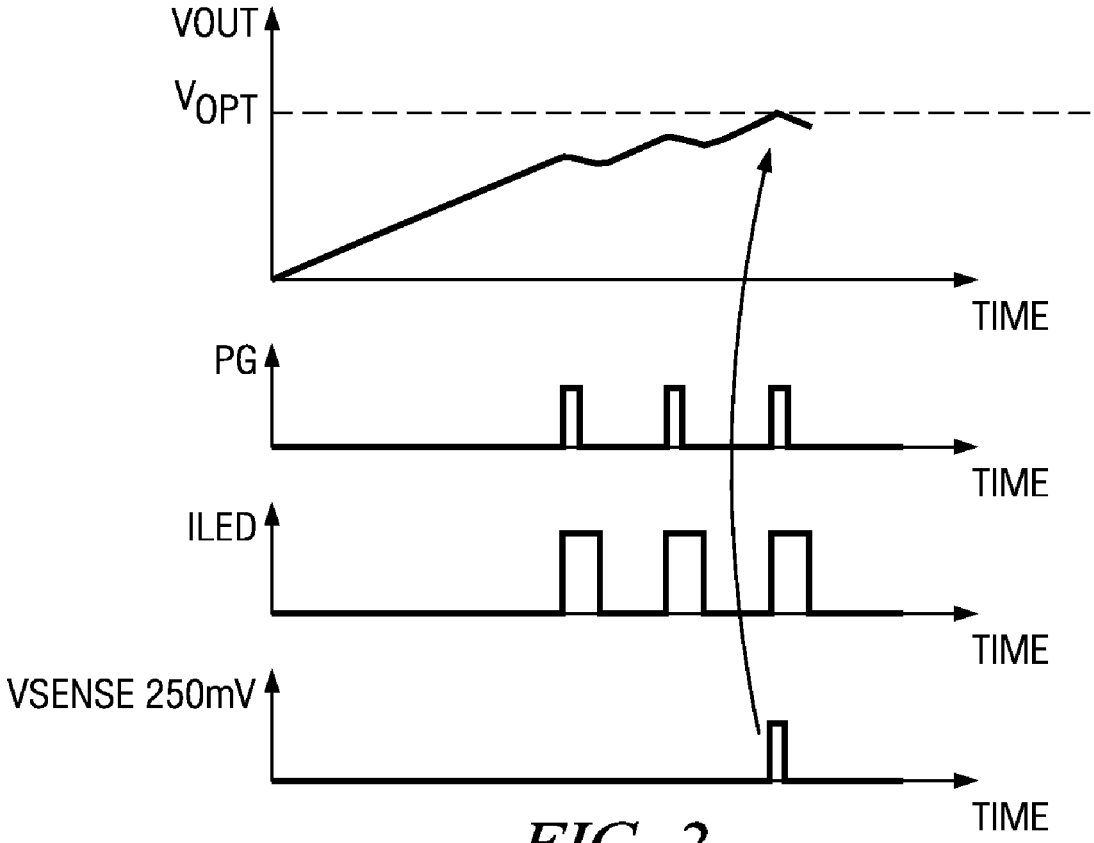
FIG. 2 is a graph of desired pre-charge voltage as a function of time for the device according to the invention.

FIG. 2 shows a graph of the voltage level at the supply voltage rail $V_{out}$, and corresponding LED current $I_{LED}$ and power PG as a function of time. This process is repeated, as shown in FIG. 2, until the controller 130 detects that each of MN1, MN2 and MN3 (or MP1 to MP3 in case of high-side drivers) have enough headroom voltage to perform a proper regulation of the current through the LEDs D1 and D2; for example, that the desired voltage $V_{opt}$ has been reached at the supply voltage rail $V_{out}$ so that the device is self-calibrating. At the end of the sequence, the device returns the desired voltage $V_{opt}$ at the supply voltage rail $V_{out}$ as digital code. In another preferred configuration, the device may return all sensed voltage drops. Further, an additional arbitrary preconfigured margin can be added to the desired output supply voltage level.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. A method for driving a plurality of light emitters in a plurality of output paths, wherein each output path includes at least one light emitter, the method comprising:

applying an supply voltage level to a plurality of output paths;

generating a current for each path during a period of a predetermined length for the output path with a storage capacitor;

sensing a current level for each output path during the period;

comparing each sensed current level with a reference level;

increasing the supply voltage level if the sensed current level is lower than the reference level;

determining a lowest supply voltage level for a worst case output path;

using the lowest supply voltage level as a common supply voltage level for all output paths; and determining a desired pre-charge voltage for a storage capacitor based at least in part on the lowest supply voltage level.

2. The method of claim 1, wherein the current level is sensed by use of a voltage drop across a current regulator.

3. The method of claim 1, wherein the light emitters are light emitting diodes (LEDs) and the current through the output paths relates to a flash strobe performed with the LEDs.

4. The method of claim 1, wherein the storage capacitor further comprises a super-capacitor.

5. The method of claim 4, wherein the desired pre-charge voltage includes a voltage drop which is due to the equivalent series resistance of the super-capacitor present during the period.

6. The method of claim 5, wherein the desired pre-charge voltage includes a voltage drop across an interconnecting structure in at least one of the output paths.

7. An apparatus comprising:

a plurality of light emitters;

a driver coupled to a plurality of outputs paths, wherein each output path includes at least one of the light emitters;

a storage capacitor that is coupled to each output path;

a current regulator coupled to each output path, wherein the current regulator is adapted to determine a current through each output path;

a controller that is coupled to the driver, the current regulator, and the output paths, wherein the controller includes:

a sensor that senses a current level for each output path and that compares each sensed current level to a reference level;

adjusters that provide control signals to the current regulator; and control logic that transmits control signals to the driver to increase a supply voltage level if at least one of the sensed current levels is lower than the reference level, and wherein the control logic determines a lowest supply voltage level for a worst case output path, and wherein the control logic uses the lower supply voltage level as a common supply voltage level for all output paths, and wherein the control logic determines a desired pre-charge voltage for the storage capacitor based at least in part on the lowest supply voltage level.

8. The apparatus of claim 7, wherein the plurality of light emitters are LEDs.

9. The apparatus of claim 7, wherein a super-capacitor is coupled to each output path.

10. The apparatus of claim 7, wherein the adjusters further comprise a plurality of digital to analog converters (DACs) .

11. The apparatus of claim 7, wherein the sensor further comprises:

a multiplexer that receives a sense signal from each output path; and a comparator that compares the output of the multiplexer to the reference level.

12. An apparatus comprising:

a first pin that is configured to be coupled to a storage capacitor and a plurality of light emitters;

a plurality of second pins, wherein each pin is configured to be coupled to at least one of the light emitters so as to form a plurality of output paths;

a current regulator that is coupled to each of the second pins;

a driver that is coupled to first pin;

a controller that is coupled to the current regulator and driver, wherein the controller is configure to determine a supply voltage level for the plurality of output paths, and wherein the controller is configured to determine a desired pre-charge voltage for the storage capacitor based at least in part on the supply voltage level.

13. The apparatus of claim 12, wherein the controller further comprises:

control logic that is coupled to the driver;

a sensor that is coupled to the each of the second pins and the control logic; and a plurality of DACs, wherein each DAC is coupled to the current regulator and the control logic, and wherein each DAC is configured to be associated with at least one of the output paths.

14. The apparatus of claim 13, wherein the sensor further comprises:

a multiplexer that is coupled to the each of the second pins; and a comparator that between the multiplexer and the control logic.

15. The apparatus of claim 14, wherein the boost regulator.

16. The apparatus of claim 15, wherein the apparatus further comprises a third pin that is coupled to the boost regulator and that is configured to be coupled to an inductor.

17. The apparatus of claim 14, wherein the current regulator further comprises:

a FET that is coupled between at least one of the second pins and ground; and a current source that is coupled to the gate of the FET and that is controlled by the control logic.

* * * * *